United States Patent [19]

Geisler et al.

[11] 4,275,525

[45] Jun. 30, 1981

[54] HOUSING WITH MOTOR AND SOLAR CELL

[75] Inventors: Diether Geisler, Grosshansdorf; Joachim Eckert, Prisdorf, both of Fed. Rep. of Germany

[73] Assignee: Beiersdorf AG, Hamburg, Fed. Rep. of Germany

[21] Appl. No.: 32,333

[22] Filed: Apr. 23, 1979

[30] Foreign Application Priority Data

Apr. 28, 1978 [DE] Fed. Rep. of Germany ... 7813145[U]
Jun. 10, 1978 [DE] Fed. Rep. of Germany ..... 2825610

[51] Int. Cl.[3] ..... A63H 33/30
[52] U.S. Cl. ..... 46/39; 136/246
[58] Field of Search ..... 46/248, 39, 40; 136/89 PC

[56] References Cited

U.S. PATENT DOCUMENTS

| | | | |
|---|---|---|---|
| 2,904,612 | 9/1959 | Regnier | 136/89 PC |
| 3,066,437 | 12/1962 | Cohn | 46/39 |
| 3,427,200 | 2/1969 | Lapin et al. | 136/89 PC |

FOREIGN PATENT DOCUMENTS

| | | | |
|---|---|---|---|
| 841259 | 6/1952 | Fed. Rep. of Germany | 136/89 AC |

OTHER PUBLICATIONS

"The Solar Cube", Solarex Corp., 8/1978.

*Primary Examiner*—Robert A. Hafer
*Attorney, Agent, or Firm*—Andrus, Sceales, Starke & Sawall

[57] ABSTRACT

The present invention relates to a housing for a solar cell driven motor suitable for use in model toys. The housing typically has an inclined surface to which the solar cells may be applied. The housing may be used to energize a toy mill, radar tower, conveyor, or lever conductor.

13 Claims, 12 Drawing Figures

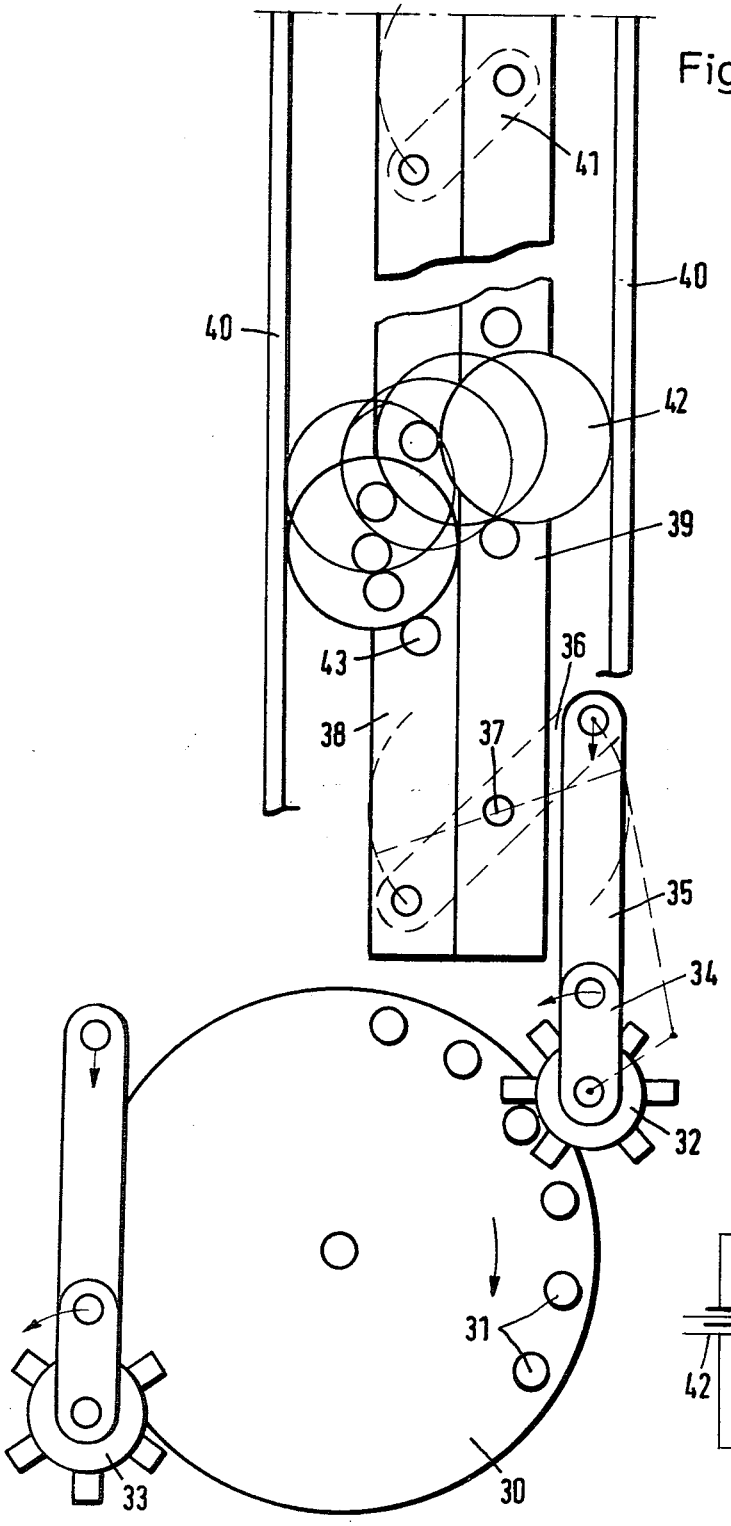
Fig.11
Fig.12
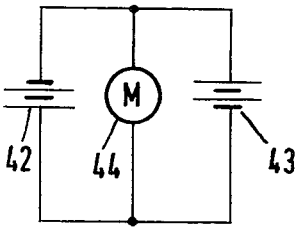

HOUSING WITH MOTOR AND SOLAR CELL

The invention relates to a housing in which a motor with an output shaft is typically arranged in connection with a gear unit.

A housing of this type is particularly suited for applications in which proportionally small generated powers are required and, at the same time, small dimensions of the motor, housing, and the like should be adhered to. Particularly for toys, it is apparent that the housing is suitable, where a wheel, a shaft, or the like should be rotated. Thus the housing can serve as a building block of a construction toy and can be assembled, as desired, with other elements.

The invention relates, in particular, to toys which have movable parts or which are altogether movable. The invention is thus concerned with the development of the associated drive, in which it is sought to use energy sources for these drives, in place of the presently used batteries or the supply out of electrical mains through wires, which are not in mechanical or other connectoion with the toy.

Accordingly, toys are provided, the moving parts of which, can be rotated, pivoted or in some other way set in motion by means of an electrical drive without the heretofore necessary electrical battery or connection to the power mains. This is attained, by a type of toy in which the rotating or moving parts are drivable by means of a motor or drive energized by means of a solar cell.

Toys can also be provided that themselves can move in which a solar cell is utilized as a drive for the motor. Thereby it should, in particular, be achieved that as much energy as possible impinge on the solar cell independently of the place and the location in which the movable toy is positioned with respect to the light source such as the sun.

Solutions for the foregoing problems emerge from the apparatus defined in the attached patent claims.

The invention is directed particularly to a drive housing, in which an electric motor with an output shaft is typically fitted into connection with a gear unit which displays proportionately small power in order to preserve the small dimensions of the motor, housing, and the like. The drive housing can be brought into connection with any toy having a wheel, a shaft, an eccentric, a lever, or the like. The drive housing can thereby serve as a building block of a toy assembleable out of individual parts and can be assembled with other elements as desired.

According to the invention, at least one solar cell electrically connected with the motor is arranged on an outer surface of the drive housing.

Further advantageous arrangements of the drive housing according to the invention will appear from the claims.

According to a preferred exemplary embodiment of the invention, the solar cells are slopingly inclined with respect to the base of the drive housing or are mounted on a domed surface, therewith an optimal orientation of the solar cells in the sun is possible. Thus the solar cells may have for the area of middle Europe, for example, an inclination to the horizontal of approximately 30°. Also the solar cells can be arranged on the drive housing so that a periodic adjustment is possible for the condition of the sun or another movable light source.

For the enlargement of the collecting surface for the sun's rays, a mirror can be arranged around the solar cells according to a preferred exemplary embodiment. For increasing the intensity of the incident light rays a light collector, for example, a fresnel lens can be provided above the solar cells.

In order to convey such light rays to the solar cells as would impinge at an angle on the outer surface of the solar cells, by which a total inflection occurs, a plurality of prism forming or lens forming projections can be found on the outer surface of the solar cells. By means of these projections those light rays which, with a planar outer surface are totally reflected, are refracted in a direction on the solar cells.

The solar cells themselves can be shaped in the form of a single element, so that these by themselves or together with a plurality of other cells can be mounted in a desired position on the drive housing by means of known attachment means.

The foregoing invention also relates to the use of a drive supplied by a solar cell in a different kinds of toys. Solely as an example, a mill, a radar tower, a conveyor, and a lever conductor are shown in the descriptive figures.

Wood serves as a preferred material for the toy according to the invention, preferably in the form of sheets of balsa or abachi in a thickness of a few millimeters. Thus on such a sheet, the shape of the necessary individual parts of the type can be drawn and punched out by means of a suitable tool. After the removal of the stamped parts these can be joined together through adhesive or the like, whereby the initially described drive can be mounted in any one of the needed positions of the toy. Advantageous exemplary forms appear in the following description and the corresponding claims.

The invention is explained with the aid of exemplary drawings.

FIG. 11 shows the essential drive parts of a toy model of a lever conductor.

FIG. 12 shows an electrical solar cell circuit according to the invention.

Figure 1:
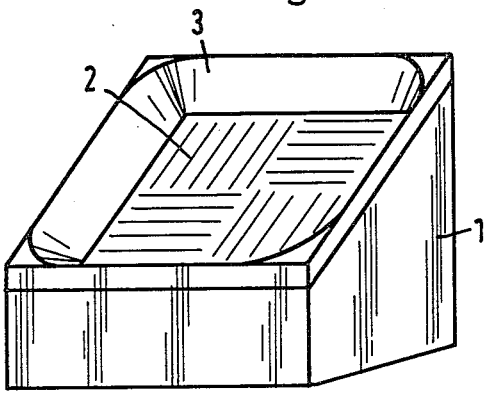
FIG. 1 shows a diagrammatic view of the drive housing according to the invention.

FIG. 1 shows an essentially cubically formed drive housing 1, which has been inclininglyy cut so that the solar cells 2 are located on the inclined surface. The solar cells are surrounded by a slantingly placed or light deflecting mirror 3, so that the light striking on the mirror is angled in the direction of the solar cells 2.

Figure 3:
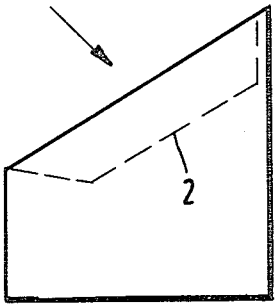
FIGS. 3 through 5 show side views of different exemplary forms of the drive housing according to the invention.
Figure 4:
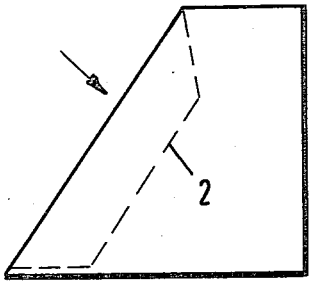
Figure 5:
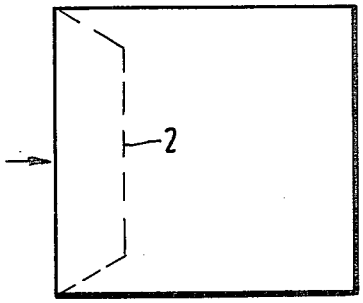

The FIGS. 3 through 5 show the essentially cubically formed housing in which the solar cells 2 are mounted on a suitable portion of the housing, whereby the position of the solar cells is so selected as to be satisfactory for the associated type of toy.

Figure 6:
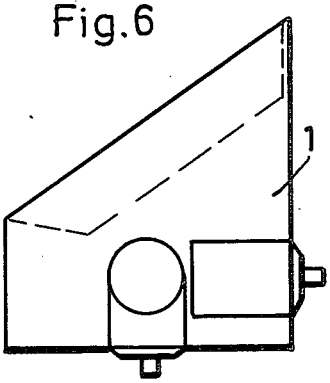
FIGS. 6 and 7 show the spatial arrangement of the motors in a drive housing according to the invention.
Figure 7:
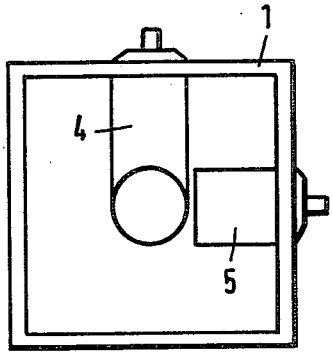

The motors 4 and 5 schematically shown in FIGS. 6 and 7 are arranged inside the housing whereby the largest part of the motor housing is arranged inside the drive housing 1 and only the drive shaft protrudes. It is obvious that the motor can be fastened on a desired portion of the housing, so that a satisfactory drive connection between the drive shaft of the motor and the driven parts is possible.

Naturally more than one motor, particularly two motors 4 and 5, can also be accommodated inside the drive housing, if this is necessary in some applications. These motors can be supplied jointly from the solar cells 2 or from separate solar cells 2.

Figure 2:
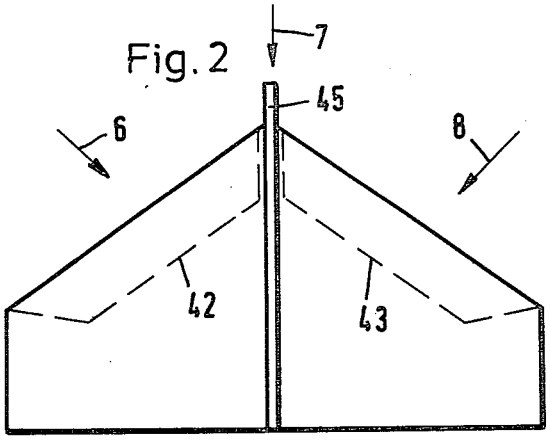
FIG. 2 shows a side view of two drive housings according to the invention which are arranged next to each other.

In FIG. 2, two drive housings 1 are so fastened to each other, that the associated solar cells 42 and 43 are ascendingly arranged with reference to the median between the pair of solar cells. The incident light has the direction of the arrow 6, so the solar cell 42 is fully struck with light when no light rays fall on the solar cell 43. The reverse is true with the incident light direction 8, when the solar cell 43 is fully struck and no light rays fall on the solar cell 42. In these circumstances the pair of solar cells 42 and 43 can be employed in order to orient both solar cells 42 and 43 so that similar amounts of light falls on both when the light falls in the direction of the arrow 7 on the solar cells 42 and 43 i.e. the solar cells 42 and 43 are so arranged, that the incident light takes on the direction of the arrow 7.

The pair of solar cells 42 and 43 are preferably connected as shown in FIG. 12. In other words, the pair of solar cells, represented in FIG. 12 as similar voltage batteries, are connected in opposition. Located between the connection of the pair of solar cells is a motor 44 or another electrical drive, relay or the like. This motor 44 can be supplied through an equalized current from the one or the other solar cell 42 or 43. For example, when the solar cell 42 is struck by incident light, the motor exhibits, for example, a counterclockwise rotation, whereas the motor exhibits a clockwise rotation, when the solar cell 43 is struck by the incident light.

On connects the motor 44 with a control element, which can change the position of the solar cells 42 and 43 with respect to the incident light, so that by means of the circuit according to FIG. 12 can it be achieved, that the motor continues to receive current until it so adjusts the solar cells 42 and 43, that the light impinges on the solar cells as shown in FIG. 2 by the arrow 7.

One employs a pair of such solar cells 42 and 43 for the adjustment in one direction and a further pair for the adjustment in a direction perpendicular to the first named direction so that both pairs of solar cells can be spatially aligned in mutually perpendicular direction on a moving light source. One employs at the same time a plurality of other solar cells in addition to the above named pairs of solar cells, so that in this manner and way it can be insured, that these further solar cells are always arranged in the optimal alignment with reference to the light source.

The previously noted effect can be increased by arranging a proportionately thin dividing wall 45 between the pair of solar cells 42 and 43, so immediately a shadow falls on the turned away solar cell with small deviation of the position of the solar cells with reference to the arrow 7. The position motor 44 is thus driven correspondingly.

Figure 8:
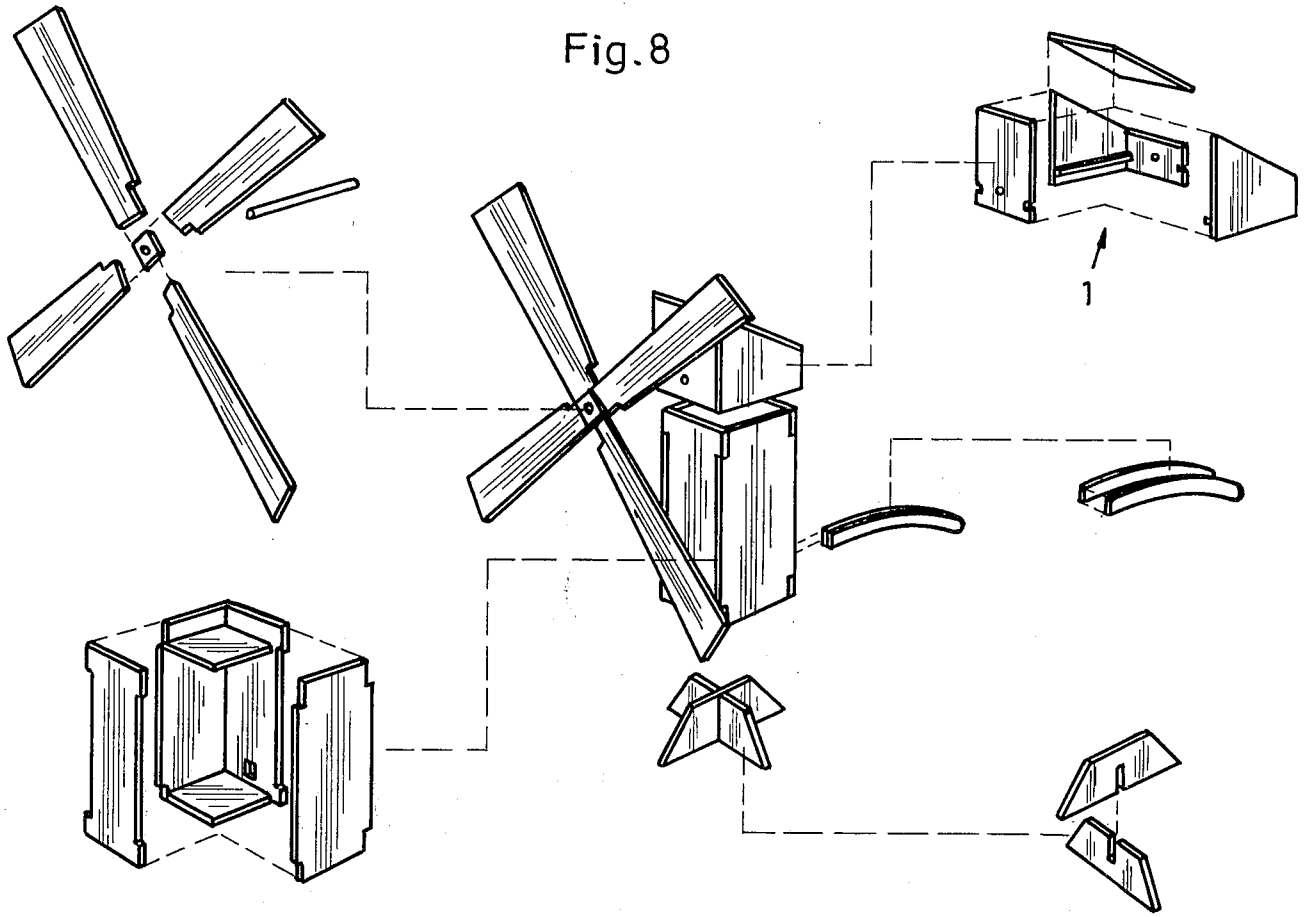
FIG. 8 is an exploded representation of a toy model of a mill.

In FIG. 8 a toy model of a mill is shown. This mill is connected with a drive housing 1 which is mounted on the upper part of the mill housing. The drive housing 1 is merely schematically reproduced: in particular the motor and the solar cells have been omitted. Essentially however, the shaft projecting out of the drive housing 1 is connected with the mill shaft.

Figure 9:
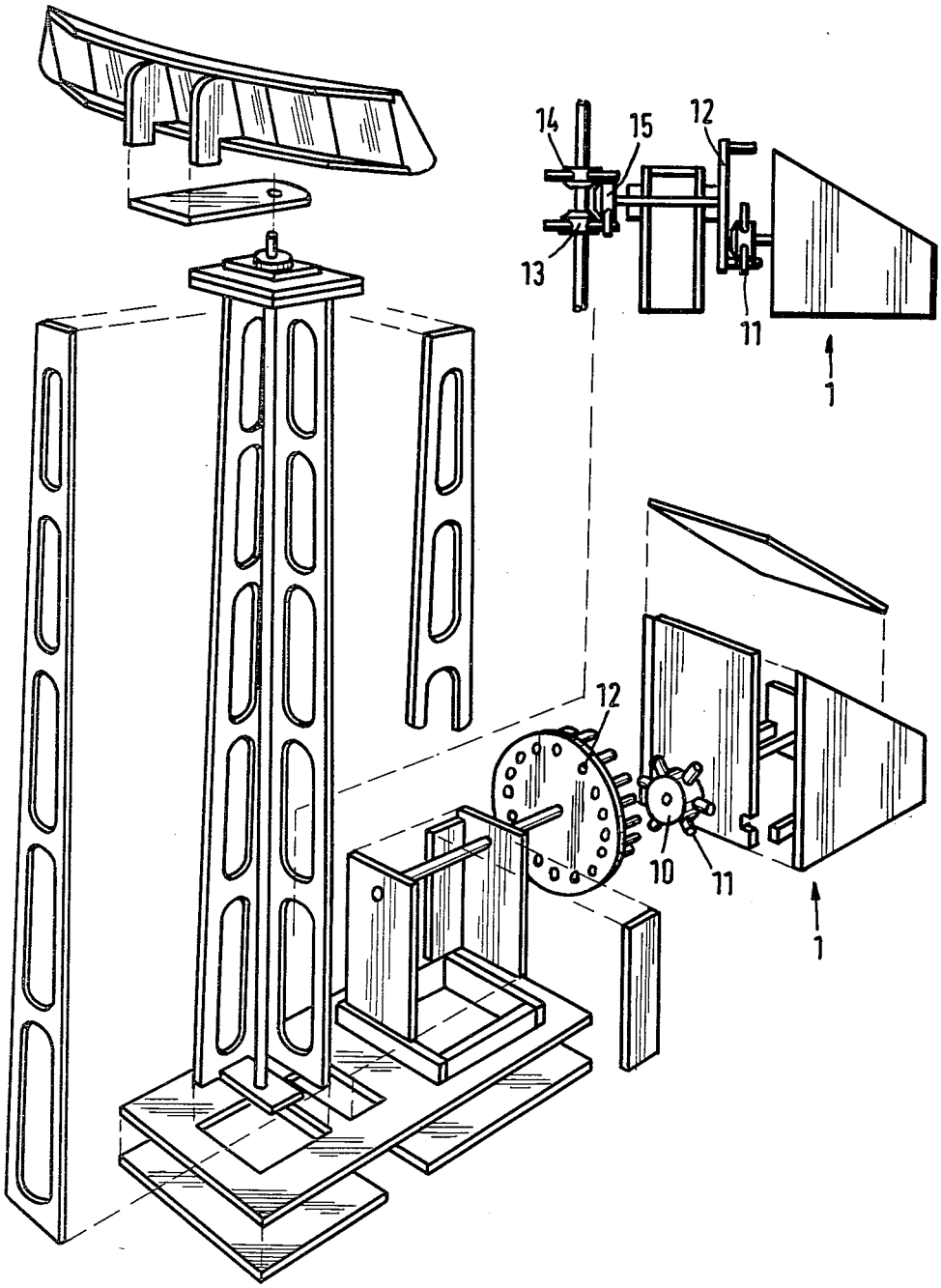
FIG. 9 shows an exploded representation of a toy model of a radar tower.

FIG. 9 shows a toy model of a radar tower, in which the radar antenna is rotatably journalled and the drive for the rotation of the radar antenna is derived out of drive housing 1, which again is only schematically represented.

On the drive shaft of the motor is located a pinion 10 with six teeth 11. This pinion 10 is arranged in rotary engagement with a pin wheel 12. This is essentially a disc from which project pins spaced from each other and parallel to the rotational axis of the disc. On the other end of the shaft of the pin wheel 12 is located a pinion 15, which in essence is correspondingly formed to the pinion 10. However, four of the total of six similar spaced projections would be removed, so that only two teeth are available for the tramsmission of the rotary movement of the pin wheel 12 through pinion 15. Above and below the pinion 15 are located two further pinions 13 and 14 which correspond to the pinion 10. Both pinions 13 and 14 are directly connected with the shaft of the radar antenna.

Through rotation of the not shown motor is a rotary action of pinion 10 translated onto the pin wheel 12 and transferred onto the pinion 15. The pinion 15 is first, for example, in driving engagement with the pinion 14 and rotates this about two incremental parts of its periphery in a first direction. After that the two projections of the pinion 15 come in engagement with the pinion 13 and rotates this correspondingly about two incremental parts of its periphery. There results to the radar antenna a to and fro pivoting motion about a part of its periphery so that the impression is obtained, that the radar tower is oriented on a certain remotely situated target.

Naturally, if instead of four teeth, fewer projections are removed from pinion 15, a different swivelling motion of the radar antenna can be obtained.

Not shown is a barrier which prevents the radar antenna from carrying out more than the desired rotational movement which can easily be the case if through the pinion 15 an excessive rotation in the radar antenna is performed.

Figure 10:
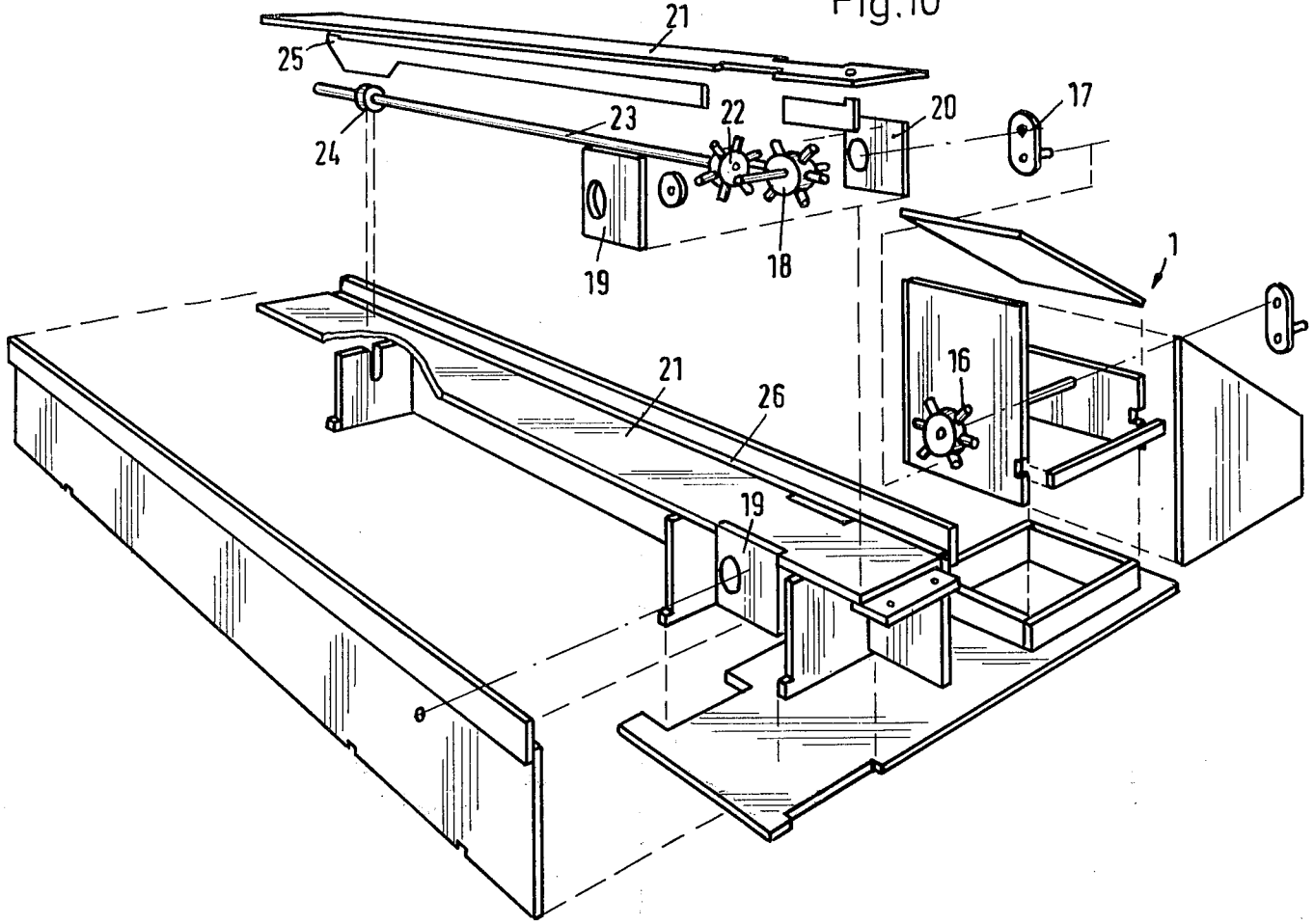
FIG. 10 shows an exploded representation of a toy model of a conveyor.

In FIG. 10 a model of a conveyor is represented which likewise by means of a solar drive is driven. The drive housing 1 is only schematically represented. On the drive shaft of the corresponding motor is found a drive pinion 16, which is arranged in rotational engagement with a crank 17. The crank 17 is journalled on a shaft which in turn is eccentrically journalled in parts 19 and 20. The parts 19 and 20 are, for their part, fastened on a plate 21 and, by rotation of the shaft of the crank 17, can move upwards and downwards so that it follows that the plate 21 is raised and lowered.

On the shaft of the crank element 17 is located further a pinion 18, that in turn is arranged in rotary engagement with a pinion 22. The pinion 22 is fastened on a shaft which carries in the opposite end an eccentric 24. This eccentric is in engagement with a lever 25 so that according to the radial extension of the eccentric 24, the lever 25 is raised and lowered. On the other hand, the plate 21 rests on the lever 25 so that through rotation of the pinion 22 and the shaft 23 and the eccentric 24 an upwardly and downwardly directed motion of the plate 21 is carried out. Through the rotation of the crank 17, the entire plate 21 is raised and lowered.

One now sets a box type object on a guide rail 26, which in the rest condition takes on the height of the middle position of the plate 21; on the oppositely lying side of the plate 21 a corresponding guide 26 is provided. Thus, the box formed object can be moved by means of the plate 21 from one to the other end when the plate 21 is cyclically raised, moved forward in the longitudinal direction, lowered, and returned in the longitudinal direction.

In FIG. 11 the parts of a lever conductor are represented, whereby the essential parts are only schematically represented.

A pin wheel 30 is placed in rotation by means of a motor fed from a solar cell in the direction specified by the arrow.

The pin wheel 30 has six teeth 31, which are only provided in one part of the periphery of the pin wheel 30 and can be brought in engagement either with a pinion 32 or with a pinion 33. The pinions 32 and 33 have six teeth, so that the six pins 31 in each case effect a complete revolution of pinion 32 or pinion 33.

On the pinion 32 a crank 34 is rotatably fastened, which has, on its other end, a pin on which a guide rod 35 is swivellingly hinged. On the other end the guide rod 35 is pivotally connected with the first end of a lever 36. The lever 36 is pivotable about a fixed pin 37 and has on its other end a pin, on which a conductor 38 is fastened. The conductor 38 is formed of two side parts, between which are found cylindrical cross bars 43. The conductor 39 is formed in a corresponding manner. Both conductors 38 and 39 stand in the rest position in the indicated condition. The cross bars of both directors are staggered relative to each other about the half cross bar spacing.

In the corresponding manner, as has been described in connection the motion drive for the conductor 38, the conductor 39 is connected with the pinion 33.

The pair of conductors 38 and 39 are located in a chute of which only two side boundaries are shown. The shaft has, in essence, the form of a square building block and, similar to conductors 38 and 39, is vertically arranged.

With the rotation of pin wheel 30, its pins 31 come into driving engagement with the teeth of pinion 32 and rotate the crank 34 in the direction of the arrow. Through this rotary movement the lever 36 is shifted so that the conductor 38 is raised. On the cross bars 43, a ball or another ball-like rolling body 42 is schematically reproduced in cross section. This rolling body is upwardly raised as a result of the further movement of conductor 38. Eventually it obtains such a height, that it carries out a rightwardly directed movement and is lifted onto a cross bar of the conductor 39. The pinion 32 is further moved, until it occupies the position shown in FIG. 11; that is, the conductor 38 has been lowered to the beginning position. The pin wheel 30 rotates further, so that the pins 31 come into engagement with the pinion 33 and the conductor 39 is now raised in a corresponding manner, so that now the rolling body 42 is raised about another part and eventually carries out a leftwardly directed movement and comes to be on the next higher cross bar to the cross bar 43. At this point the conductor 39 is lowered to the beginning position. Thereafter the initially described process is repeated. By means of the described apparatus it is possible to raise a rolling body in the vertical direction whereby also another body, such as a ball or a cylindrical roller, can be raised, if the conductors or their cross bars are suitably designed. For example, cylindrical barrels could be fastened on the cross bars 43 in order to facilitate the leftward or rightward directed movement of the body to be raised. Link 41 couples the upper ends of conductors 38 and 39 together.

It is thus pointed out that not only the previously described types of toys can be driven through a single solar cell, but also that it is possible to utilize the arrangement shown in FIG. 2 in order to carry out movement of the solar cell producing the drive energy, so that this is constantly optimally adjusted to a moving light source.

Various modes of carrying out the invention are contemplated as being within the scope of the following claims particularly pointing out and distinctly claiming the subject matter which is regarded as the invention.

We claim:

1. A unitary drive module for a model toy comprising:

a housing means suitable for mounting in association with said toy, said housing means comprising a pair of contiguous housings;

a motor contained within said housing means, said motor having an output shaft extending from said housing means and couplable to moving parts of the model toy for driving same;

at least one solar cell mounted on the exterior of each of said housing and electrically connected to said motor for energizing the motor, said solar cells being orientable toward a light source, said solar cells being connected in an anti-parallel circuit; and an adjustment drive for changing the position of the solar cells connected in said anti-parallel circuit.

2. A drive module for a model toy according to claim 1 characterized in that the housings of said housing means are prismoidally formed with a polygonal base surface and an inclined surface sloping with respect to the base surface on which said solar cell is mounted.

3. The drive module for a model toy according to claim 2 characterized in that this sloping surface is inclined at an angle of 30° with respect to the base surface.

4. A drive module for a model toy according to claim 1 characterized in that the exterior surface of the solar cell has a plurality of projections of at least one of the prismatic, tetrahedral, and lens forming type.

5. A drive module for a model toy according to claim 1 characterized in that the walls of the housings of said housing means are formed out of at least one of plastic, wood, and metal stamped parts.

6. The drive module according to claim 1 further including an associated toy in the form of a toy mill, wherein said drive module is connected to the blades of said mill.

7. The drive module according to claim 1 further including an associated toy in the form of a radar tower, wherein the output shaft is connected to a pinion drive unit; the pinion (10) being arranged in driving arrangement with a pin wheel (12); a shaft of the pin wheel (12) being provided with a pinion (15) which has fewer teeth than the pinion (10); wherein above and below the pinion (15), pinions (13 and 14) are arranged in driving arrangement with the pinion (15); and wherein the pinions (13 and 14) are connected with the rotary shaft of the radar antenna; whereby the pinion (15) is bringable into engagement either with the pinion (13) or the pinion (14) during a revolution of the pin wheel (12).

8. The drive unit according to claim 1 further including an associated toy in the form of a conveyor, wherein said output shaft is connected to a pinion (16) arranged in rotary engagement with a crank (17); the shaft carried by the crank (17) being journalled eccentrically in bearing parts (19 and 20), whereby the bearing parts (19, 20) are raisingly and loweringly connected with a plate (21); and wherein on the shaft carried by the crank (17) is further arranged a pinion (18), which with a further pinion (22) is arranged in rotary engagement; the pinion (22) being fastened on a shaft (23) which is connected on the other end of the plate (21) with an eccentric (24) with which the other end of plate (21) is raisingly and loweringly connected.

9. A drive module according to claim 1 further including an associated toy in the form of lever conductor, wherein a pin wheel (30) driven from the output shaft of motor (5) is provided with a plurality of pins (31) on a part of the periphery, which either with a pinion (32) or with a pinion (33) during a revolution of the pin wheel (31) are arranged in driving engagement; the pinion (32) being fastened on a crank (34); the crank (34) being connected with a guide (35); the guide (35) being pivoted on a lever (36), which, in turn, is pivotable about a fixed pin (37); the other arm of the lever (36) being connected with a to and fro movable conductor (38), and wherein a further conductor (39) is connected in a corresponding manner with the pinion (33), conductors (38, 39) being arranged in a chute (40) to exert a lifting force on a rolling body (42).

10. A drive module according to claim 1 characterized in that mirror means is mounted on the housing means for increasing the efficiency of the solar cells.

11. The drive module according to claim 1 characterized in that a light ray collector is arranged in front of at least one of the solar cells.

12. A drive module for a model toy according to claim 2 wherein said contiguous housings are arranged back-to-back with said inclined surfaces sloping away from the contiguous portions of the housings.

13. A drive module for a model toy according to claim 1 characterized in that a dividing plate between the contiguous housings extends above the contiguous portions of housings.

* * * * *